US007043775B2

(12) United States Patent
Holtsnider et al.

(10) Patent No.: US 7,043,775 B2
(45) Date of Patent: May 16, 2006

(54) DOUBLE PULSATING HYDROTHERAPY JET

(75) Inventors: Michael D. Holtsnider, Moorpark, CA (US); Raymundo Colin, Simi Valley, CA (US)

(73) Assignee: B & S Plastics, Inc., Oxnard, CA (US)

( * ) Notice: Subject to any disclaimer, the term of this patent is extended or adjusted under 35 U.S.C. 154(b) by 7 days.

(21) Appl. No.: 10/611,475

(22) Filed: Jun. 30, 2003

(65) Prior Publication Data

US 2004/0261171 A1 Dec. 30, 2004

(51) Int. Cl.
*A61H 33/00* (2006.01)

(52) U.S. Cl. ..... 4/541.6; 239/249

(58) Field of Classification Search ..... 4/541.6; 239/249, 253, 259

See application file for complete search history.

(56) References Cited

U.S. PATENT DOCUMENTS

| | | | | |
|---|---|---|---|---|
| 4,320,541 A | 3/1982 | Neenan | 4/492 |
| 4,508,665 A | 4/1985 | Spinnett | 4/541.6 X |
| 5,269,029 A | 12/1993 | Spears et al. | 4/514.6 |
| 5,444,879 A | 8/1995 | Holtsnider | 4/541.01 |
| 5,457,825 A | 10/1995 | Holtsnider | 4/541.1 |
| 5,657,496 A | 8/1997 | Corb et al. | 4/541.6 |
| 5,920,925 A | 7/1999 | Dongo | 4/541.6 |
| 6,178,570 B1 | 1/2001 | Denst et al. | 4/541.6 |

OTHER PUBLICATIONS

Waterway Plastics, Inc. 1999 Product Catalogue, p. 4, Parts 210-6120 and 210-6510.

Waterway Plastics, Inc. 1997 Product Catalogue, p. 1 (Deluxe & Octagon Series Pulsating Jet) and (Standard Poly Jets Whirly and Pulsator Jets).

*Primary Examiner*—Robert M. Fetsuga
(74) *Attorney, Agent, or Firm*—Koppel, Jacobs, Patrick & Heybl

(57) ABSTRACT

A pulsating hydrotherapy jet is disclosed which has a jet body with a water inlet to allow water to flow into the body. The jet body discharges the water through a discharge member in more than one concentric pattern. A cap mounted on the body to receive the circular water patterns is also disclosed. The cap has a number of openings that form more than one concentric opening ring. Each of the opening rings align with a respective one of the circular water patterns to provide the sensation of a number of circular patterns of multiple pulsating jets. A system for providing a hydrotherapy jet to a reservoir of water is also disclosed. The system includes a reservoir shell capable of holding water with a number of hydrotherapy jets according to the invention that are mounted around the reservoir shell. A water pump system circulates water from the reservoir to the jets.

11 Claims, 9 Drawing Sheets

Section (2-2)

(Section7–7)

(Section (8–8)

FIG. 10
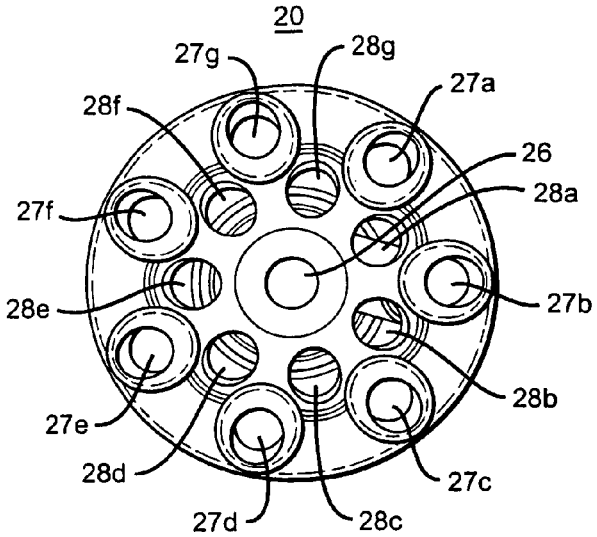
FIG. 10a
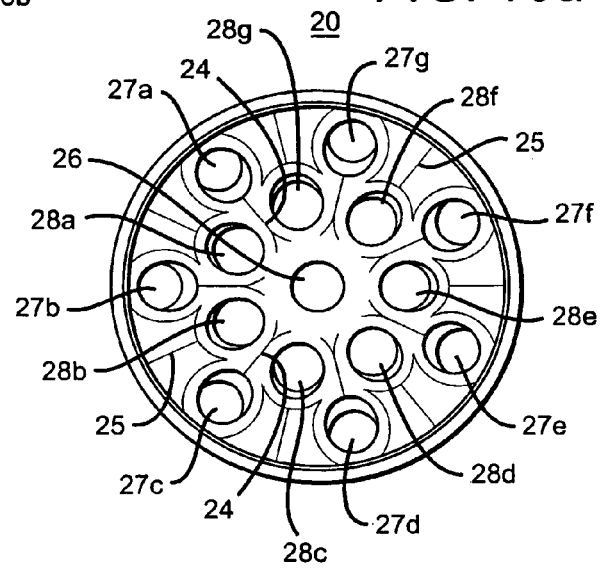
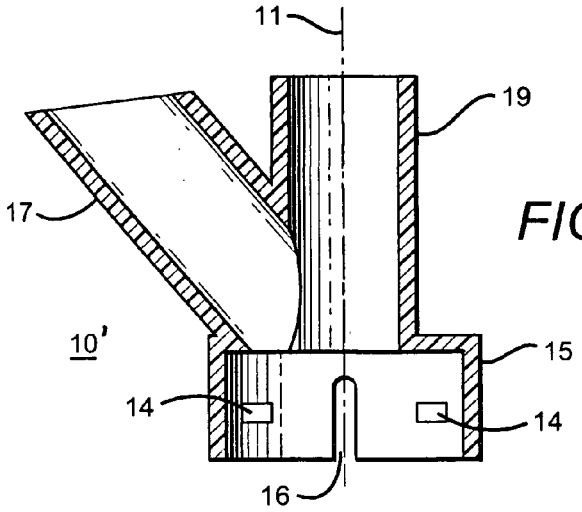
FIG. 11

DOUBLE PULSATING HYDROTHERAPY JET

BACKGROUND OF THE INVENTION

1. Field of the Invention

This invention relates to hydrotherapy jets.

2. Description of the Related Art

Various hydrotherapy jets have been developed for use in spas, hot tubs, pools and bath tubs that discharge a stream of water that can be aerated through a variety of discharge nozzles. Designs of these hydrotherapy jets provide different flow characteristics that result in different massage effects being experienced by the body. Such jets have been found to produce a pleasing massage effect for many users, and have become quite popular. In the design of single or multi-use spas or tubs, it is common to use a variety of different jet nozzles to provide a variety of different massaging effects.

Early jets simply discharged a stream of warm water along the longitudinal axis of the jet body, with later jets providing aeration of the water stream. Since then numerous jets have been developed in which the direction of the stream can be adjusted. For example, U.S. Pat. No. 5,269,029 to Spears, et al. (assigned to the same assignee as the present invention) discloses a jet that provides an off axis stream of water and has an axial push-pull mechanism used to control the flow of water. The mechanism can also be rotated to rotate a stream of water around the jet axis, thus providing directional control over the stream.

Jets have also been developed having a rotating outlet or eyeball that automatically rotates in response to water flowing through the outlet. As an example, see Waterway Plastics, Inc., "1999 product catalog," page 4, including part nos. 210-6120 and 210-6510. In these jets, the outlet can be adjusted off the jet's longitudinal axis to provide a turning moment in the eyeball in response to the water stream flow.

U.S. Pat. No. 6,178,570 to Denst et al. (assigned to the same assignee as the present invention) discloses a jet having a rotating eyeball with one or more discharge outlets that can be adjusted to vary the direction of the outlet flow stream, as well as the direction and speed of the eyeball's rotation. A high-pressure water stream flows through the outlets and, depending on the orientation of the outlets, the eyeball can rotate clockwise or counter-clockwise at different speeds.

U.S. Pat. No. 5,920,925 to Dongo (assigned to the same assignee as the present invention) discloses a jet having a rotating eyeball and a cap formed with a number of openings positioned at a common radius from the center of the cap. The jet produces a high-pressure water stream that flows through the eyeball, causing it to rotate at a high speed and discharge the jet in a circular pattern that impinges on the openings. Together, the rotational speed and the opening design produce the sensation of a number of simultaneously pulsating water streams that are directed into the spa.

Various hydrotherapy jets have been developed in the past for use with spas, hot tubs, and bath tubs that discharge an aerated stream of water through a variety of discharge nozzles. In general, such jets produce a constant flow stream that provides a good therapeutic effect. However, in an attempt to enhance the therapeutic effect, several systems have been designed that produce a pulsating flow. These systems have met with varying degrees of success as they often require additional or larger components, which increase system cost and add complexity, or generate unwanted pressure losses, thus requiring a larger pump than would otherwise be required.

One prior art approach has been to use mechanical devices to pulse water flowing to an individual jet, or a series of jets. An example of such a system is described in U.S. Pat. No. 4,320,541 to John S. Neenan. In this approach a series of mechanical blocking devices are used to intermittently block and unblock a flow stream. As a flow stream is unblocked, a pulse of water is sent to the jet and ultimately to the user. While this approach does provide a pulsating effect, blocking and unblocking of the flow stream causes abrupt pressure increases imposing a strain on spa systems. Aside from these drawbacks, such systems require additional components that add complexity, cost and weight. In addition, since the pulsation effect is generated away from the jet, the pulsed flow stream experiences a pressure loss, resulting in a decreased pulsation effect being felt at the jet exit.

In an alternate approach, rather than using mechanical devices to generate a pulsed flow, a hydraulic pumping device is used. In such a system, pulsation is produced by a distribution valve which houses a rotor that is rotated by inlet water flow, and distributes the inlet water to a series of outlets which are connected into the individual jets. The rotor is formed with a groove that sequentially aligns the water outlets to the water inlet so that each outlet is periodically connected to, and then disconnected from, the inlet. The water is supplied into each jet in a pulsating or chopping manner. Examples of this system are given in the U.S. Pat. Nos. 5,444,879 and 5,457,825 to Michael D. Holtsnider and assigned to Waterway Plastics, Inc. the assignee of the present invention.

While hydraulic systems do provide a degree of pulsation, they too suffer from many of the same problems as mechanical systems. For example, as the pulsation effect is generated away from the jet, the pulsed flow stream experiences a pressure loss which results in a reduced pulsation effect at the jet, and like the mechanical systems the additional componentry adds complexity, cost and weight to the system. Also, a larger water pump may be required to provide additional energy to rotate the rotor and to compensate for additional pressure losses.

To overcome the drawbacks associated with mechanical and hydraulic pulsed systems, pulsation systems have been designed that do not require mechanical devices or hydraulic distribution systems. Such systems generally have individual pulsation mechanisms located within the individual jets. Examples are shown in the Waterway "1997 product catalog," page 1, deluxe and octagon series pulsating jet, and in U.S. Pat. No. 5,657,496 to Corb et al., also assigned to Waterway Plastics, Inc. The individual jets contain rotational devices commonly called eyeballs. The eyeballs have water conduits which discharge water flowing through the jet into the spa or tub. The conduits are angled to cause the eyeball to rotate and distribute the flow stream in a circular pattern. The circular distribution provides, to some degree, the sensation of a pulsed flow as the flow stream interacts with a specific point on the body in a periodic fashion. However, this is not truly a pulsed flow since the user actually experiences a continual flow stream, but in a circular pattern.

Attempts have been made to produce a jet that would produce a true pulsed flow. To this end, several designs have been developed in which pulsation is created at the jet itself. In these systems the flow stream at the jet is blocked periodically to create the sensation of a pulsed flow. See Waterway Plastics, Inc. "1997 product catalog" page 1, Standard Poly jets whirly and pulsator jets, and U.S. Pat. No. 4,508,665 to Spinnett. While both the Waterway and Spinnett Jet designs do in fact produce a pulsed flow, the pulsating is created by blocking the flow stream exiting the discharge member as it rotates past a blocking member. When the flow stream comes in contact with the blocking member the flow is temporarily interrupted or halted, thus generating a pulsed flow that is circular or spiral in nature, moving from one zone to another in a sequential manner. The blocking, however, creates an undesirable backflow into the jet, causing strain on the spa system and ultimately lowering efficiency. In addition, the Spinnett design requires multiple deflections of the flow stream as it passes through the jet, causing pressure losses and lowering the system efficiency.

SUMMARY OF THE INVENTION

The invention includes a jet body, a water inlet, a channel within the jet body, a discharge member, and a cap with having a plurality of openings. The jet body produces a high-pressure water stream that flows through the discharge member, causing the discharge member to rotate, and discharges the water stream in a number of concentric patterns. Together the rotation speed and the plurality of openings produce the sensation of a number of concentric rings each having multiple pulsating water streams that are directed into the spa dr tub.

BRIEF DESCRIPTION OF THE DRAWINGS

These and other further features and advantages of the invention will be apparent to those skilled in the art from the following detailed description, taken together with the accompanying drawings, in which:

FIG. 10 is a top plan view of one embodiment of the cap used in the jet of FIG. 2;

FIG. 10*a* is a bottom plan view of one embodiment of the cap used in the jet of FIG. 2

FIG. 11 is a sectional view of one embodiment of the discharge member used in the jet of FIG. 2;

DETAILED DESCRIPTION OF THE INVENTION

Figure 1:
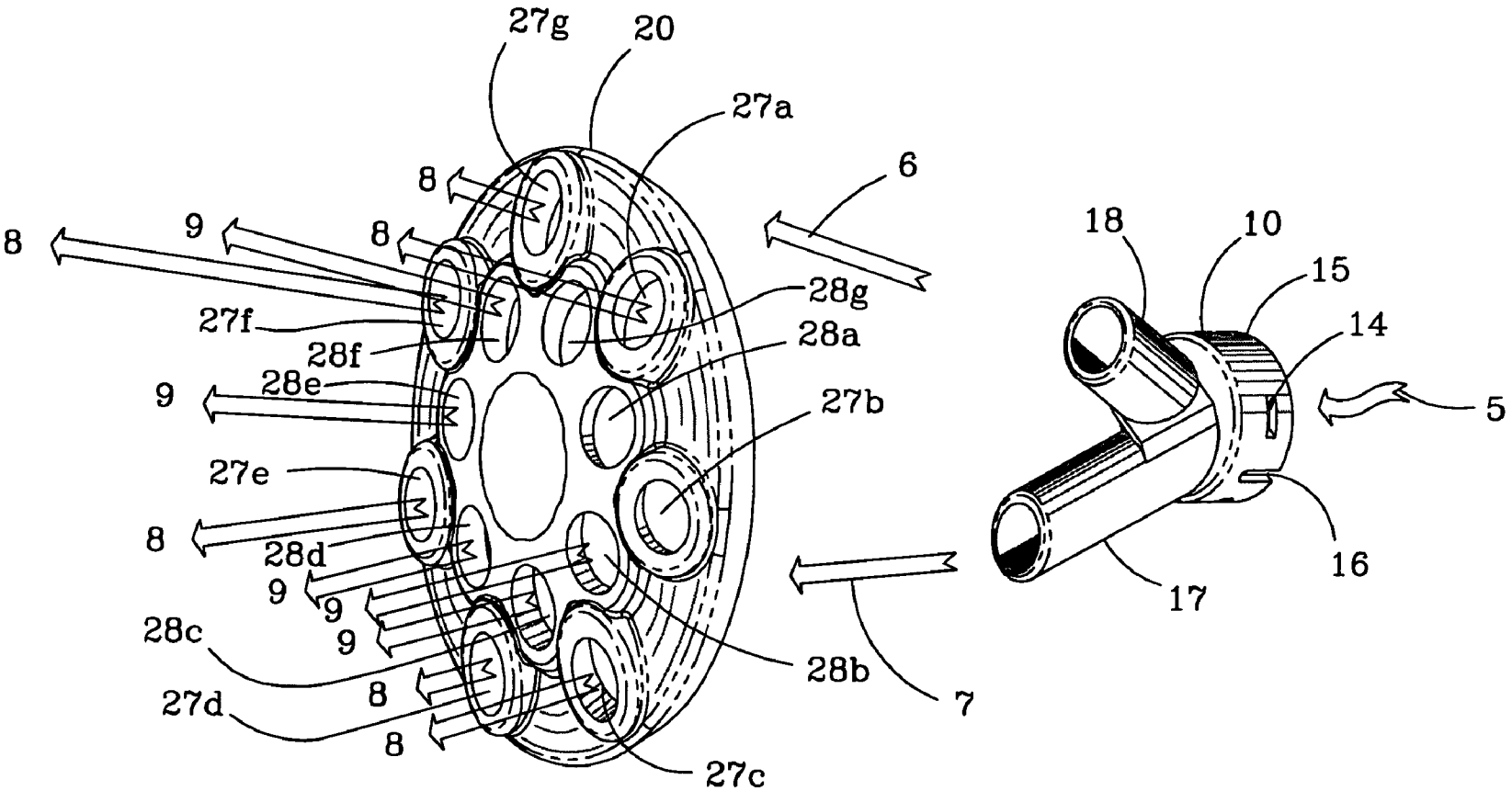
FIG. 1 is a simplified exploded perspective view of a pulsating hydrotherapy jet unit in accordance with the invention.

The invention, as shown in FIG. 1, relates to a low-pressure loss hydrotherapy jet system 40 that uses a single water supply 3 (not shown) and a single air intake 4 (not shown) to produce multiple concentric, rings of simultaneously pulsating water streams in a spa bath. As shown in FIG. 1 aerated water stream 5 enters discharge member 10, which has a major outlet conduit 17 and a minor outlet conduit 18. Water stream 5 enters discharge member 10 and splits into subsidiary streams 6 and 7, which exit discharge member 10 through minor outlet conduit 18 and major outlet conduit 17 respectively. Subsidiary streams 6 and 7 discharge in concentric patterns from discharge member 10. The subsidiary streams 6 and 7 impinge a concentric arrangement of openings 28*a*–28*g* and 27*a*–27*g* respectively disposed on cap 20. Subsidiary stream 7 passing through openings 27*a*–27*g* generates a ring of major pulsating streams 8. Subsidiary stream 6 passing through openings 28*a*–28*g* generates a ring of minor pulsating streams 9.

In one embodiment the upstream contours surrounding the openings creates ridges that divert the rotating discharge member to the respective openings without generating substantial back flow. In one embodiment, when discharge member 10 receives a water supply having a pressure of at least 10 pounds per square inch (psi), discharge member 10 rotates fast enough that the user may have the sensation of major and minor pulsating streams 8 and 9 pulsating simultaneously. Minor pulsating stream 9 may appear to be concentric with major pulsating stream 8. In one embodiment discharge member 10 may rotate at speeds of at least 500 revolutions per minute (rpm). In one embodiment, the system has the added advantage that its design results in lower pressure losses.

Figure 12:
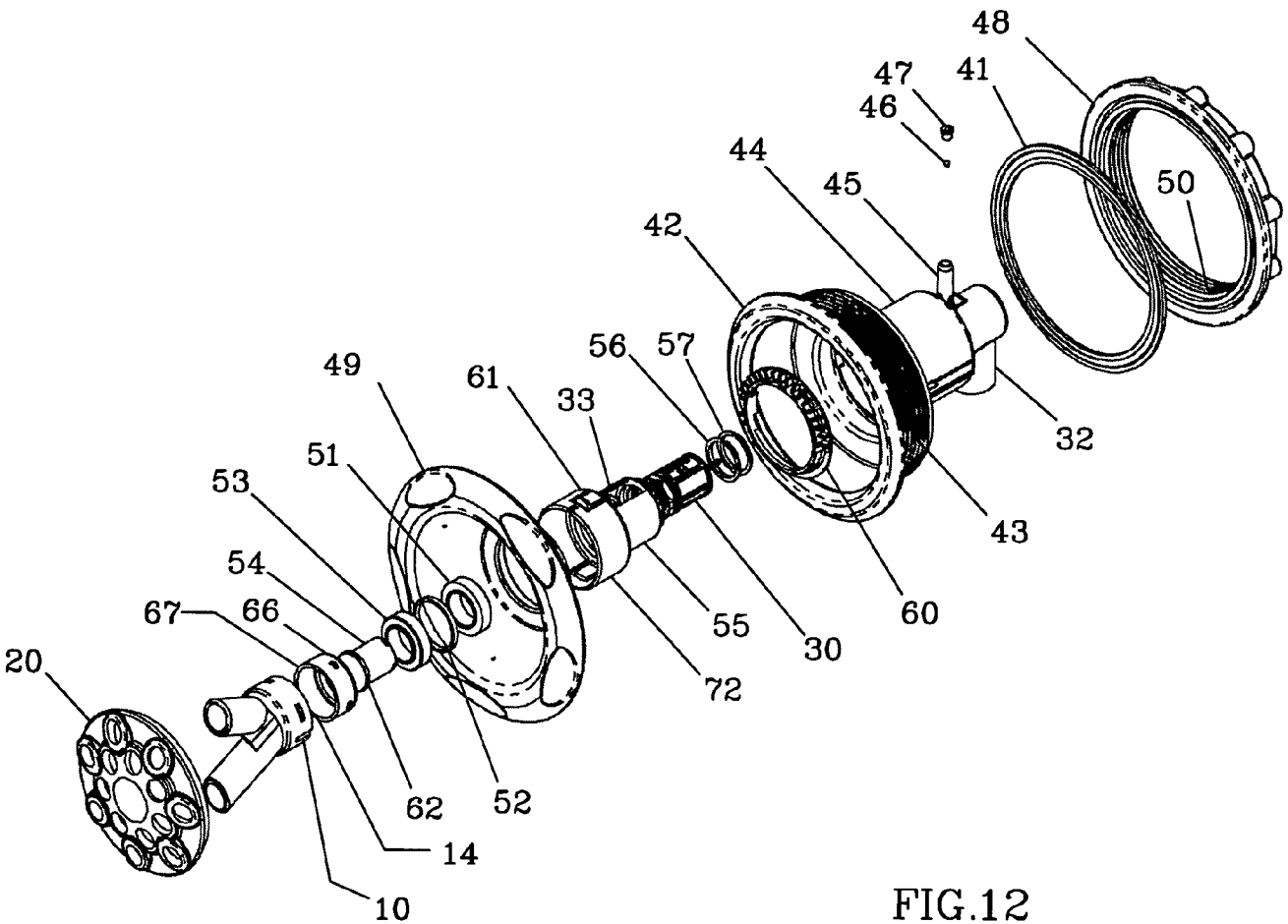
FIG. 12 is an exploded perspective view of a double pulsating hydrotherapy jet unit of FIG. 9.

FIG. 1 also shows discharge member 10 has a discharge member sleeve 15 that connects to inner discharge member sleeve 67 (shown in FIG. 12). Locking slot 14 on discharge member sleeve 15 allows sleeve attachment tab 66 (shown in FIG. 12) to connect inner discharge member sleeve 67 to discharge member 10. Alignment slot 16 allows alignment of discharge member 10 to inner discharge member sleeve 67.

Figure 2:
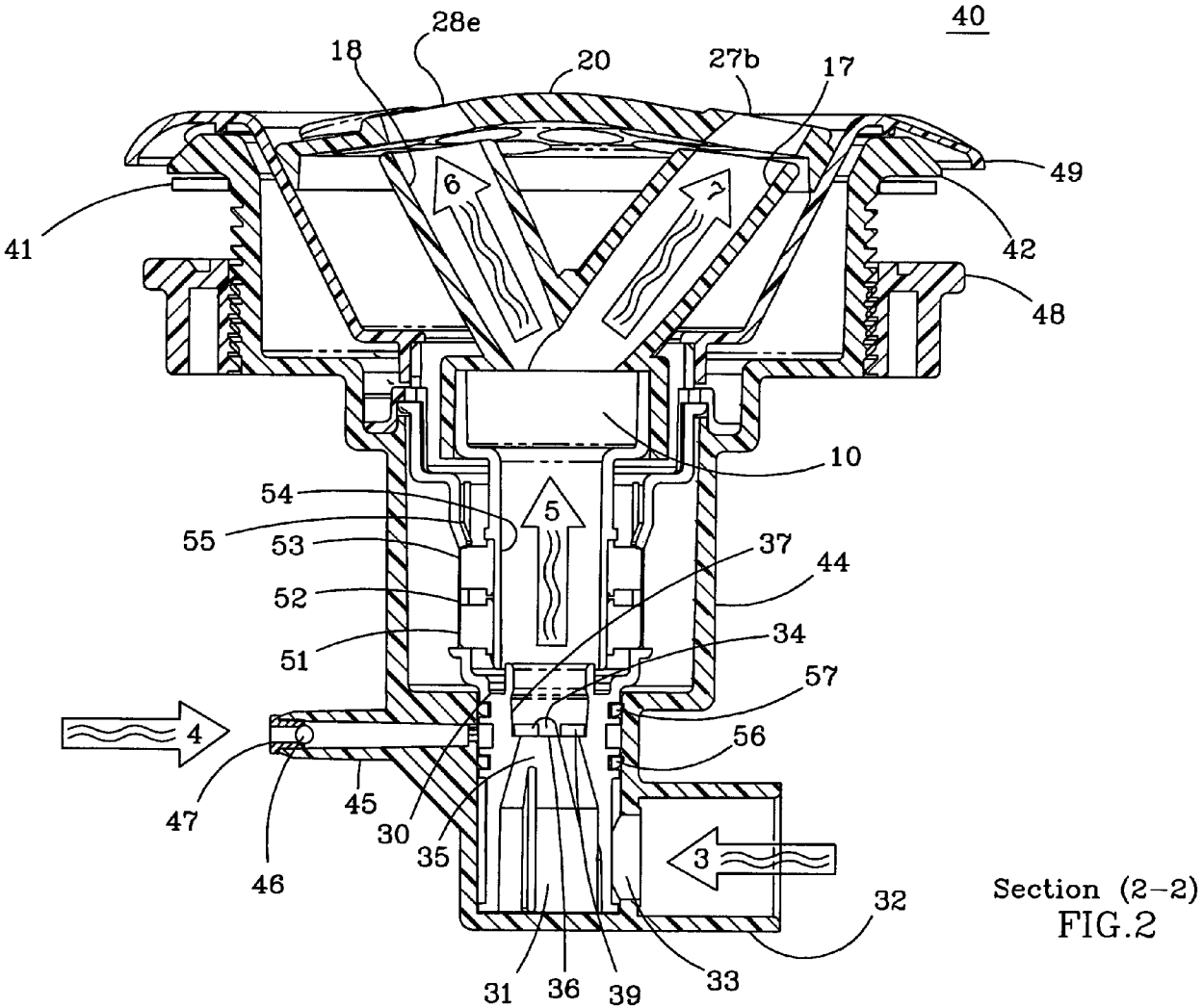
FIG. 2 is a sectional view taken along section line 2—2 of the double pulsating hydrotherapy jet unit of FIG. 9.

As shown in FIG. 2 major outlet conduit 17 diverts aerated water stream 5 away from the longitudinal axis of water stream 5, and forms subsidiary stream 7. In one embodiment, subsidiary stream 7 may impart a rotational moment to discharge member 10. Minor outlet conduit 18 also deflects aerated water stream 5 away from its longitudinal axis forming subsidiary stream 6, but does not divert it as far away as major outlet conduit 17. In one embodiment, minor subsidiary stream 6 may impart a rotational moment to discharge member 10.

Channel 31, in FIG. 2, receives water supply 3 flowing from inlet 32 through exit port 33. Exit port 33, whose axis is normal to that of Channel 31, constricts the flow of water supply 3 and provides it to inlet 32. Attached to exit port 33, at its upstream end, is a venturi sleeve 30 that houses a venturi 34. Venturi 34 has an upstream section 35 that tapers down to its smallest diameter at throat 36. At throat 36, venturi 34 expands in diameter forming an aft section 37. Air intake 4 enters through air conduit 45. Aft of throat 36, in section 37, are located a series of air openings 39 used to entrain air supply 4 to aerate the water flowing through venturi 34. In this manner, air intake 4 is entrained into water supply 3 forming aerated water stream 5.

In one embodiment, as shown in FIG. 2, major outlet conduit 17 diverts part of aerated water stream 5 into diverted major outlet conduit aerated water stream 7. Diverted major outlet conduit aerated water stream 7 leaves discharge member 10 through major outlet conduit 17. Minor outlet conduit 18 diverts part of aerated water stream 5 into the minor outlet conduit 18. Subsidiary stream 6 leaves discharge member 10 through minor outlet conduit 18. Major and minor aerated subsidiary streams 7 and 6 exiting discharge member 10 thru major outlet conduit 17 and minor outlet conduit 18 respectively encounter openings 27*a*–27*g* and 28*a*–28*g* respectively. In FIG. 2, aerated water stream 5 exits discharge member 10 as major subsidiary stream 7 thru major ring opening 27*b*, and minor subsidiary stream 6 thru minor ring opening 28*e*.

Discharge member 10 can be seen just up stream of cap 20. The cross section of major opening 27*b* may be seen in cap 20. A cross section of minor opening 28*e* may also be seen in cap 20. FIG. 2 shows major outlet conduit 17 lining up with major ring opening 27*b* allowing major outlet conduit aerated water stream 7 to exit double pulsating hydrotherapy jet unit 40. FIG. 2 also shows minor outlet conduit 18 aligning up with minor ring opening 28*e* permitting subsidiary stream 6 to exit double pulsating hydrotherapy jet unit 40.

Figure 4:
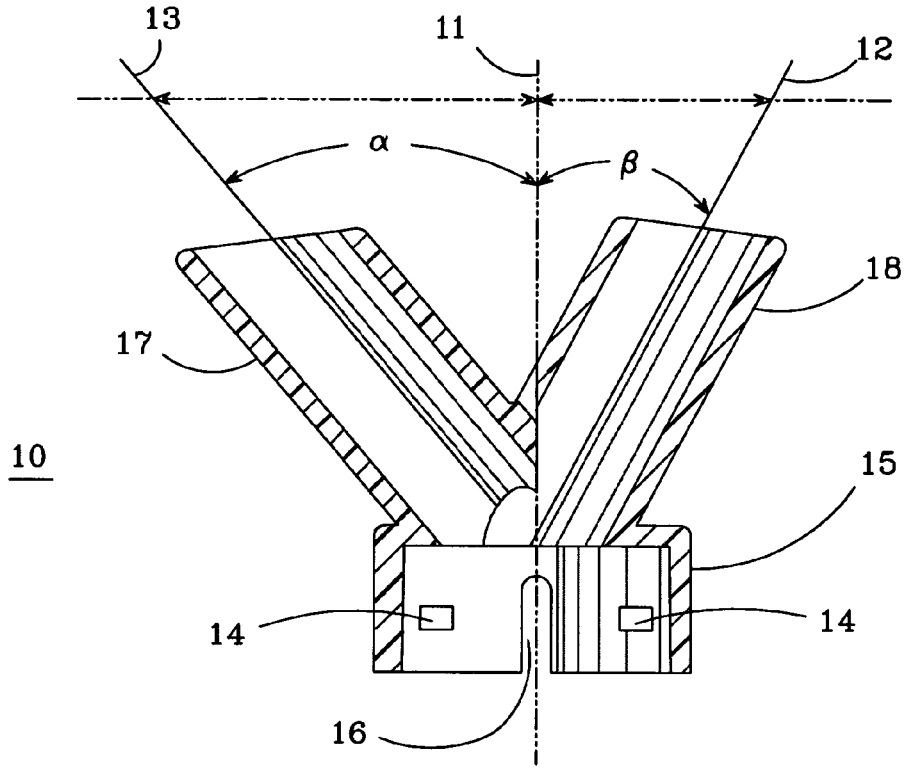
FIG. 4 is a sectional view taken along section line 4—4 of the discharge member of FIG. 3.

Washer 52 separates bearing rakes 53 and 51 in FIG. 2 from each other. Bearing rakes 53 and 51 permit discharge member 10 to rotate freely around rotational axis 11 as shown in FIG. 4. These bearing rakes 53 and 51 fit over inner bearing sleeve 54 and are attached thereto. The combination of inner bearing sleeve 54, bearings 53 and 51 and washer 52 are then snugly fit inside outer bearing sleeve 55 as is also shown in FIG. 12. The positioning of bearing rake 51 and bearing rake 53 outside bearing sleeve 54 keeps the bearings separate from aerated water stream 5, reducing the chance that over time these bearings might seize. Additionally, having two bearing rakes 51 and 53 reduces the wear that would be encountered by a single bearing rake, thus extending the life of the jet.

Washers 56 and 57, as shown in FIG. 2, confine air uptake 4 entering thru air conduit 45 allowing it to aerate water stream 3 producing aerated water stream 5. Conduit 45 has a check valve comprising check valve ball 46 and check valve ball retainer 47. The check valve prevents water from escaping double pulsating hydrotherapy jet unit 40 back thru air conduit 45. When water enters air conduit 45 check ball 46 is forced against check ball retainer 47 sealing the conduit closed.

As discharge member 10 rotates around its longitudinal axis, major outlet conduit 17 sweeps consecutively through major openings 27*a* to 27*g*. As major outlet conduit 17 sweeps through an opening 27*a*–27*g* in cap 20, subsidiary stream 7 passes through said opening creating major pulsating stream 8 (shown in FIG. 1).

As discharge member 10 rotates around its longitudinal axis, minor outlet conduit 18 sweeps consecutively through minor openings 28*a*–28*g*. As minor outlet conduit 18 sweeps through an opening 28*a*–28*g* in cap 20, subsidiary stream 6 passes through said opening creating minor pulsating stream 9 (shown in FIG. 1).

As may be seen in FIG. 2, in one embodiment major opening 27*b* may be aligned with major outlet conduit 17, and thus does not substantially impede the flow of subsidiary stream 7 through major outlet conduit 17. In one embodiment, all openings 27*a*–27*g* may be aligned with major outlet conduit 17 as opening 27*b* is shown here. In one embodiment minor opening 28*e* may be aligned with minor outlet conduit 18, and thus opening 28*e* does not interfere substantially with the flow of water out of minor outlet conduit 18. In one embodiment, all openings 28*a*–28*g* may be aligned with minor outlet conduit 18 as opening 28*e* is shown here.

Figure 3:
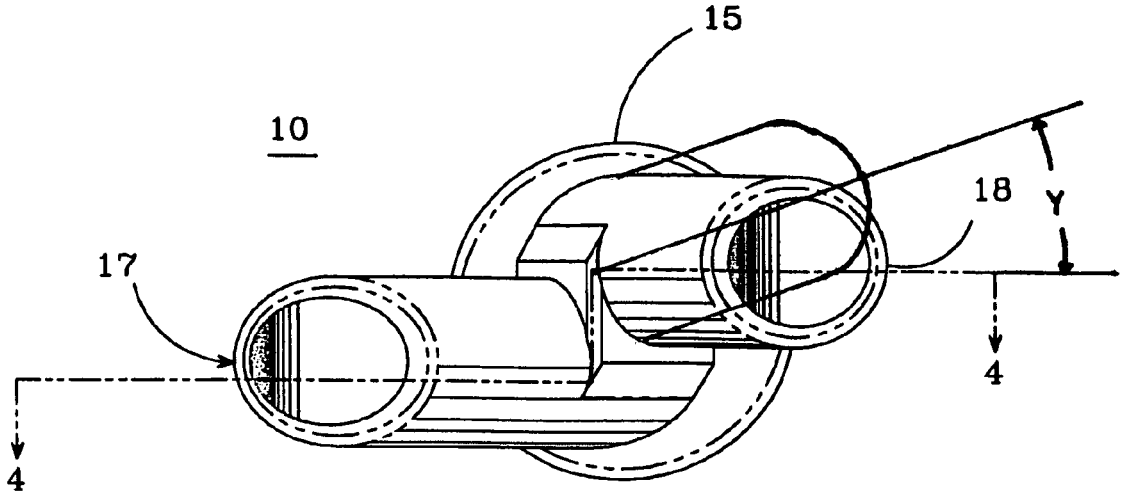
FIG. 3 is a top plan view of the discharge member used in the jet of FIG. 1.

In one embodiment, as shown in FIG. 3 major outlet conduit 17 extends further away from the center axis 11 (shown in FIG. 4) of discharge member 10 then does minor outlet conduit 18.

FIG. 4 shows discharge member 10 has an axis of rotation 11 that is collocated with the longitudinal axis of aerated jet 5 (shown in FIG. 2). FIG. 4 further demonstrates major outlet conduit 17 extending further away from the centerline then does minor outlet conduit 18. In one embodiment, conduits 17 and 18 extend up and out from discharge member 10 in a manner that suggests asymmetric bunny ears.

In one embodiment discharge member 10 has a rotational axis 11 with the two linear water outlet conduits 17 and 18 passing through it. Major outlet conduit 17 has a longitudinal axis 13 that is coplanar with axis 11. Minor outlet conduit 18 has a longitudinal axis 12 that is coplanar with axis 11. Major outlet conduit's 17 longitudinal axis 13, and minor outlet conduit's 18 longitudinal axis 12 are orientated at angles $\alpha$ and $\beta$ respectively to axis 11 of discharge member 10. In one embodiment $\alpha$ may be greater than 37 degrees, and $\beta$ may be greater than 21 degrees. In another embodiment one or both of axes 12 and 13 are further offset by an angle $\gamma$ (as shown in FIG. 3) in a direction normal to offsets defined by angles $\alpha$ and $\beta$ to provide a turning moment to discharge member 10 in response to a jet flow. Subsidiary streams 6 and 7 exiting rotational member 10 trace out concentric patterns, as discharge member 10 rotates, which may be perceived as solid rings of water. In one embodiment angle $\gamma$ may be approximately 6 degrees.

In one embodiment as shown in FIGS. 2, 3 and 4 major water outlet conduit 17 and minor water outlet conduit 18 pass through and extend downstream from discharge member 10, and are spaced approximately 180 degrees apart from one another about axis 11. Angles $\alpha$, $\beta$ and $\gamma$ are set such that discharge member 10 obtains sufficient rotational speed to provide what may be perceived to be multiple continuous solid concentric bands of water. Interaction of the water bands with cap 20 ultimately may provide the user with the sensation of multiple concentric simultaneously pulsating water streams.

Figure 5:
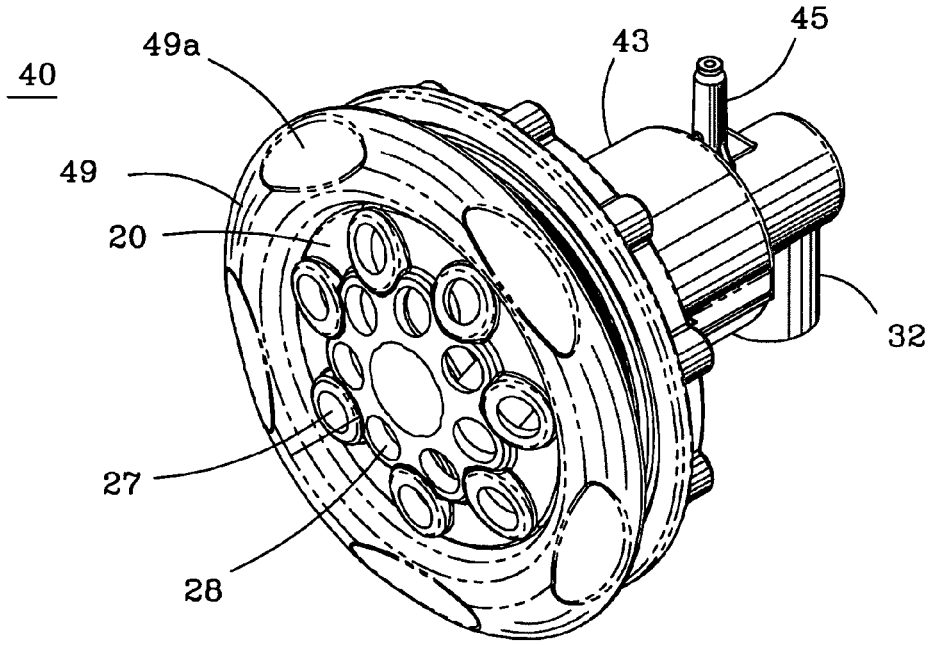
FIG. 5 is a perspective view of a fully assembled double pulsating hydrotherapy jet unit.

FIG. 5 shows double pulsating hydrotherapy jet unit 40. Cap 20 may be placed within rotating scallop plate 49. Scallops 49*a* on rotating scallop plate 49 allow the reduction of the flow of water supply 3 to double pulsating hydrotherapy jet unit 40 by rotating discharge member carrier 55 to occlude a portion of water inlet 32 as shown in FIG. 2.

Figure 6:
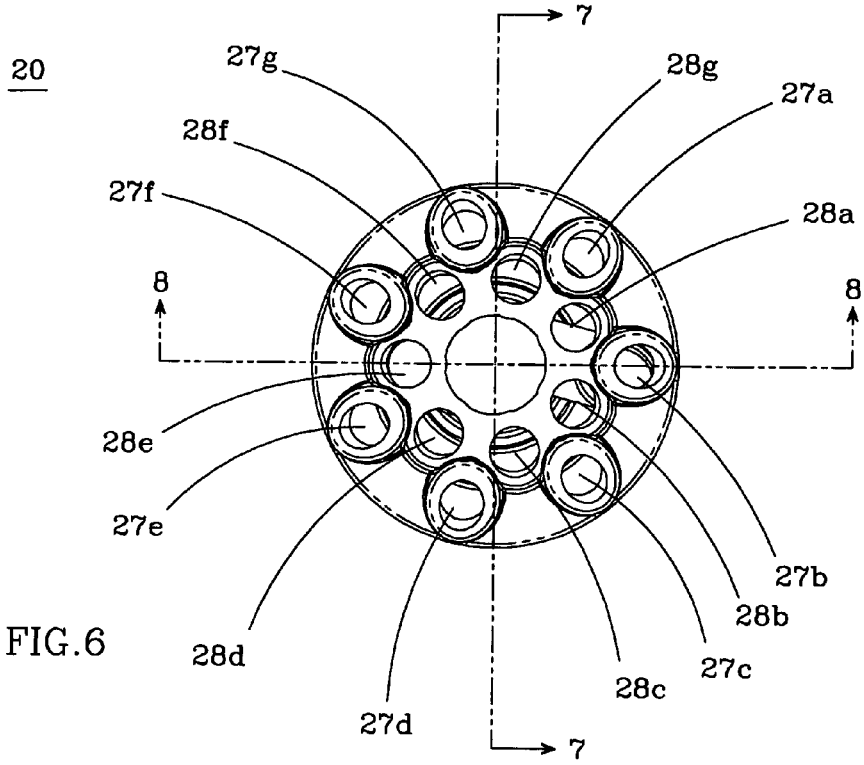
FIG. 6 is a front elevation view of the cap used in the jet of FIG. 5.

In one embodiment, as shown in FIG. 6, cap 20 contains two series of 7 cylindrical openings 27*a*–27*g* and 28*a*–28*g*. Cap 20 has major ring openings 27*a*–27*g* arrayed around the edge of cap 20 at a common radial distance from the center, or longitudinal axis of cap 20 that coincides with longitudinal axis 11 of discharge member 10 when assembled, i.e. in a circle. Also cap 20 has arrayed around its center a circle of minor ring openings 28*a*–28*g* that are arrayed at a common radial distance from the longitudinal axis of cap 20. In one embodiment the radius of major ring openings 27*a*–27*g* may be greater than the radius of minor ring openings 28*a*–28*g*.

Figure 7:
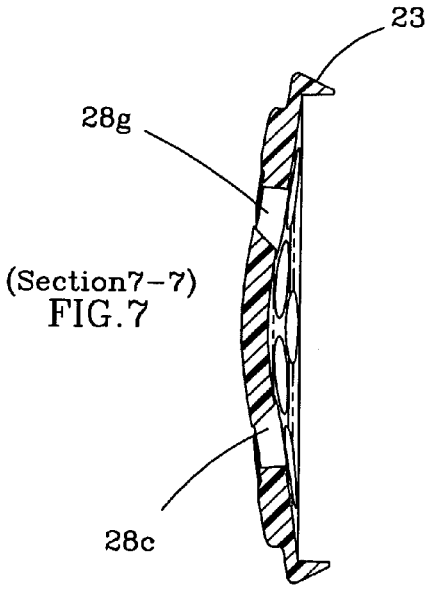
FIG. 7 is a sectional view taken along section line 7—7 of the cap of FIG. 6.

FIG. 7 shows the curve of cap 20, and cap edge ridge 23. Cap edge ridge 23 assists in securing cap 20 within scallop ring 49. This cross section of cap 20 partially exposes minor ring openings 28*e* and 28*g*.

Figure 8:
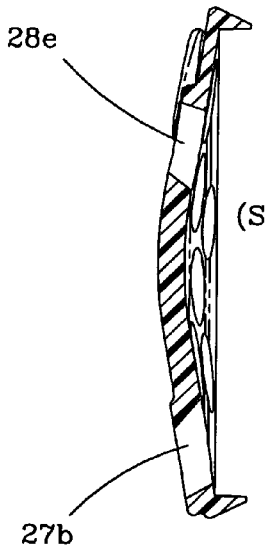
FIG. 8 is a sectional view taken along section line 8—8 of the cap of FIG. 6.

FIG. 8 cuts directly through the center of major opening 27*b* and minor opening 28*e*. This specific arrangement of openings is one embodiment of a cap for a double pulsating hydrotherapy jet unit 40. Other embodiments will be equally effective in providing the double pulsating hydrotherapy jet effect.

Figure 9:
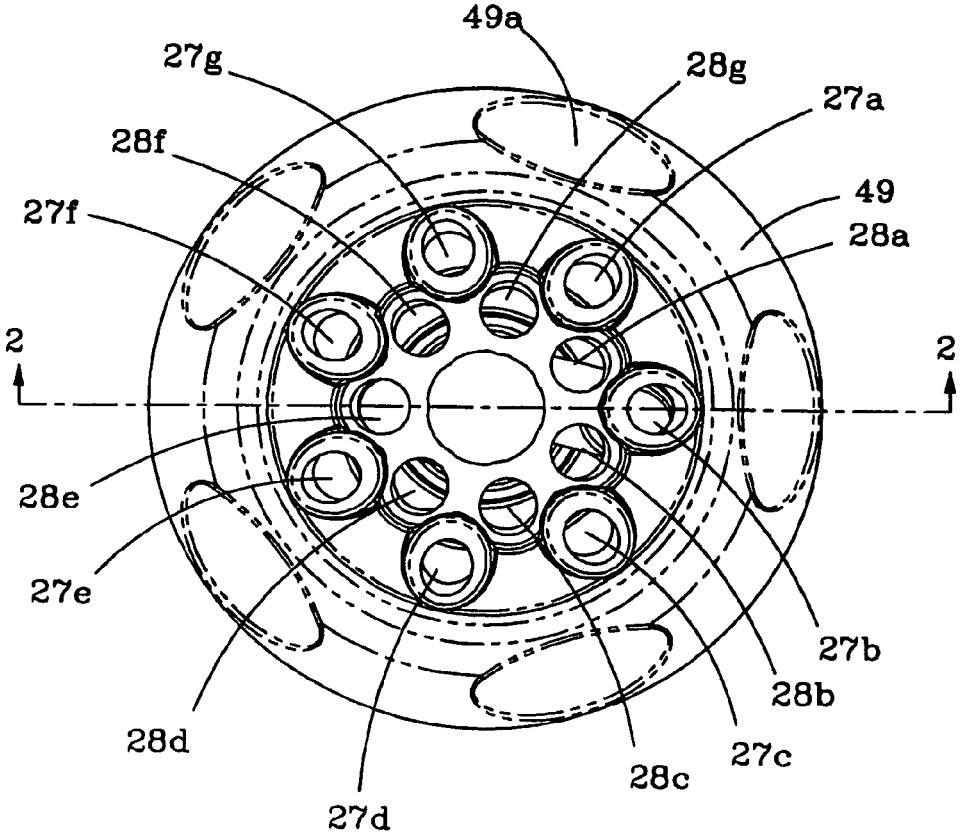
FIG. 9 is a front elevation view of an assembled double pulsating hydrotherapy jet unit.

FIG. 9 shows an assembled double pulsating hydrotherapy jet unit 40 showing cap 20 and rotating scallop ring 49. Scallops 49*a* can be seen around the periphery of rotating scallop ring 49. Scallops 49*a* allow better finger grip while rotating scallop ring 49 to adjust the rate of flow of water supply 3. Major ring openings 27*a*–27*g* may be seen just inside rotating scallop ring 49. Cap 20 on which major ring openings 27*a*–27*g* are placed is in fact placed over and nestled within rotating scallop plate 49. In one embodiment, minor ring openings 28*a*–28*g* may be seen nested inside and between major ring openings 27*a*–27*g*.

In one embodiment, shown in FIG. 10, cap 20 may have an opening 26 in its center. Center opening 26 may be used to allow discharge of centralized water outlet conduit 19 of FIG. 11.

As is shown in FIG, 10*a*, upstream of openings 27*a* through 27*g* at the intersection of the openings are a series of raised contours 25 between the openings. In one embodiment the contours 25 form ridges that divert water provided from conduit 17 into one or more of openings 27*a* through 27*g*. The ridges cut the water, diverting it into the openings. The cutting action allows the water to flow into openings without producing substantial back flow as may be the case if the surfaces between the openings had no ridges. Similar raised contours 24 may be seen between openings 28*a* through 28*g* that divert water provided from conduit 18 into one or more of bore holes 28*a* through 28*g*, thus reducing backflow. The contours 24, 25 can have many different shapes and sizes.

In one embodiment, as shown in FIG. 11 discharge member 10 may contain a centralized water conduit 19 coaxial with the longitudinal axis 11 of discharge member 10. The centralized water conduit provides a continuous nonpulsating jet to the user in addition to the series of pulsating jets.

FIG. 12 demonstrates how all the individual parts of double pulsating hydrotherapy jet unit 40 relate to one another, and are assembled. Front flange 42 and gasket 41 combine with locking thread ring 48 to grasp the side of a hydrotherapy spa or tub shell 70 (shown in FIG. 13). Gasket 41 prevents leakage of water from a hydrotherapy spa or tub shell 70. Locking thread ring 48 screws down over exterior threading 43 with interior threading 50. Rotational movement of locking thread ring 48 towards the front of double pulsating hydrotherapy jet unit 40 compresses front flange 42 against gasket 41 and compresses gasket 41 against a wall of hydrotherapy spa or tub shell 70. Gasket 41 is seated behind front flange 42. Housing 44 supports stationery and rotating portions of double pulsating hydrotherapy jet unit 40. This assembly attaches double pulsating hydrotherapy jet unit 40 to the wall of hydrotherapy jet bath.

Mechanical mount retaining ring 60 is placed into Housing 44 to hold outer bearing sleeve 55 in a fixed position. Exit port 33 on outer bearing sleeve 55 permits water from water inlet 32 to enter the interior of double pulsating hydrotherapy jet unit 40. Discharge member carrier outer sleeve 72 permits attachment to rotating scallop plate 49. Locking feature 61 locks and makes secure the attachment of discharge member carrier 72 to rotating scallop plate 49.

Inner bearing sleeve ridge 62 is used as a stop to prevent bearing rakes 53 and 51 from moving too far forward along inner bearing sleeve 54.

Discharge member 10 slides over and encompasses inner discharge member sleeve 67. Discharge member 10 is held in place by the interlocking of sleeve attachment tab 66 and discharge member attachment slot 14 (shown in FIG. 1). Cap 20 is attached to rotating scallop plate 49. Cap 20 is stationery compared to, and moves with rotating scallop plate 49. Discharge member 10 is mounted at the down stream end of venturi sleeve 30. Venturi sleeve 30 contains aerated water stream 5. Discharge member 10 is designed so impingement by aerated water stream 5 generates a rotational moment causing discharge member 10 to spin about its axis of rotation 11. Located down stream of discharge member 10 is cap 20, which diverts the water flowing from discharge member 10 to produce simultaneous pulsating jets 8 and 9.

Figure 13:
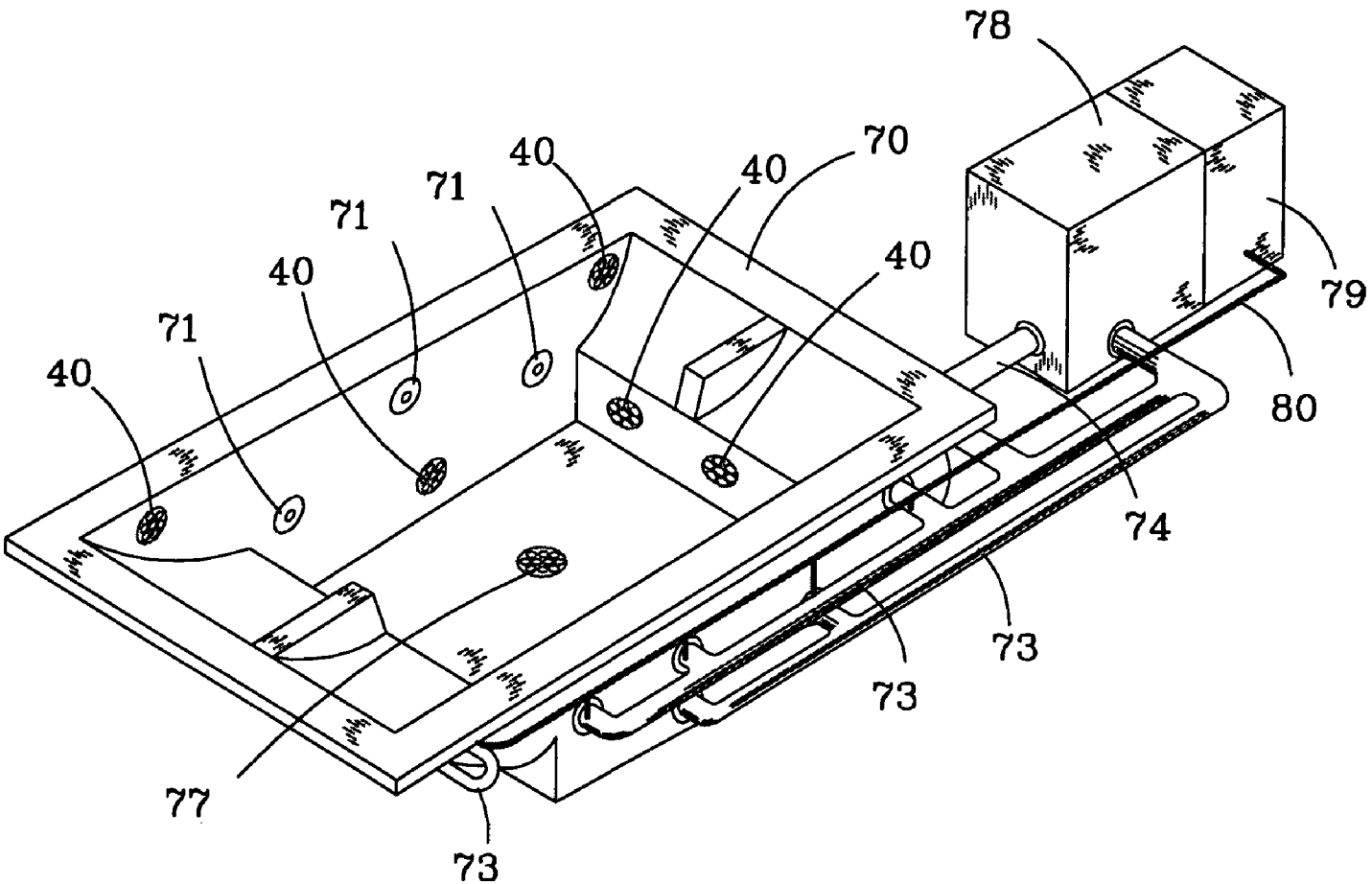
FIG. 13 is a perspective view of a spa/tub system using the present invention.

As shown in FIG. 13, multiple jets can be installed in a spa or tub shell 70. In this disclosure, spa shell is defined as any bath, pool, reservoir or spa capable of containing a fluid and enabling immersive recreation or therapy. Some or all of the jets can be one of the jets described above, with the jets in this embodiment being jet 40. The remaining jets 71 may be any other desired type, such as a variety of prior single nozzle jets. Both types of jets are connected to a water pump 78, used to circulate the water throughout the spa system, by a series of water conduits 73. Water from shell 70 is provided to pump 78 through the drain 77, which is connected through return water conduit 74 to pump 78. Water from pump 78 is provided back to shell 70 by conduits 73, where it flows into jets 40 and 71, as the case may be, and in turn into shell 70, completing the loop. Additionally, an air system 79 may be included that provides air to individual jets 40 and 71 through an air conduit 80, to aerate the water flowing through the jet. The air system 79 can be pump driven to increase the pressure of the air entering the jet 8, or can be vacuum based with the venturis located within the jets 40 and 71 drawing air into the jets and water flow stream.

Figure 14:
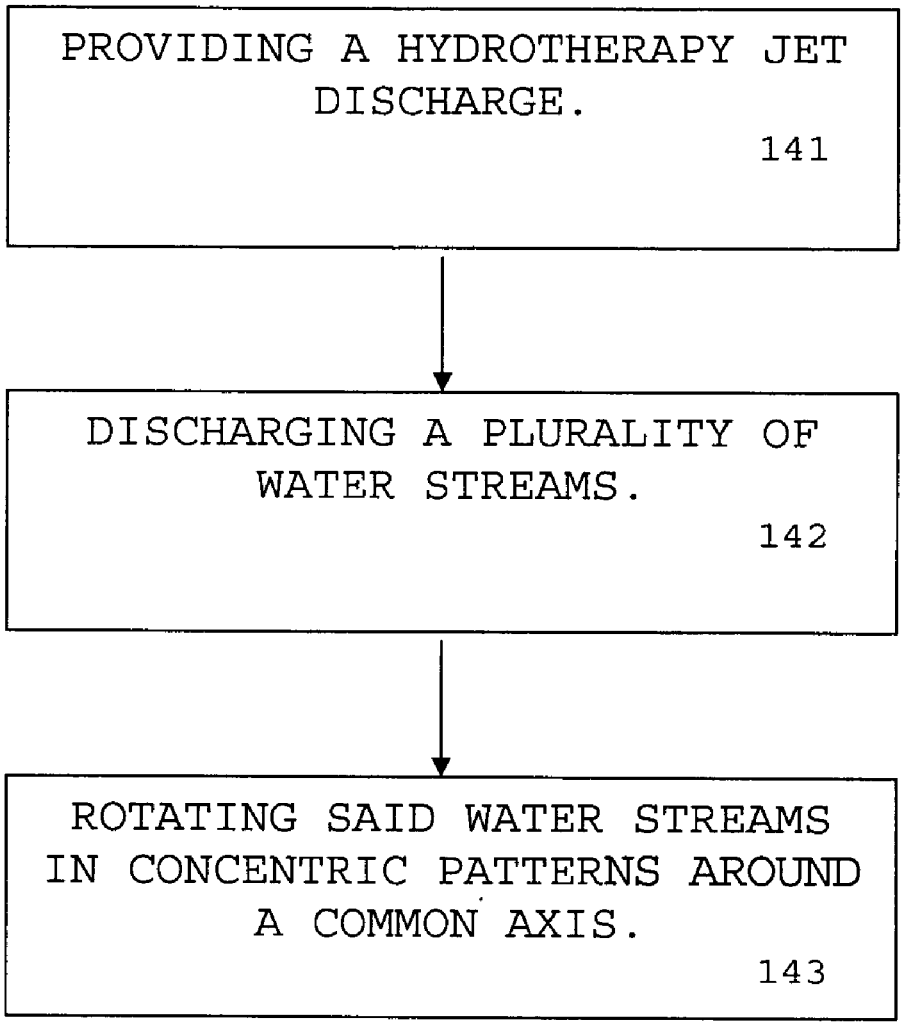
FIG. 14 is a flowchart demonstrating one embodiment of the claims.

FIG. 14 shows a flow diagram of one embodiment of the claimed invention. A hydrotherapy jet discharge is provided in block 141. A plurality of water streams is discharged in block 142. The water streams are rotated in concentric patterns around a common axis in block 143.

Although the present invention has been described in considerable detail with references to certain preferred configuration thereof, other versions are possible. Therefore, the spirit and scope independent claims should not limited to the preferred version contain therein.

I claim:

1. A pulsating hydrotherapy jet, comprising:

a jet body;

a water inlet to said body;

a channel within said body for forming water flowing from said inlet into a water stream;

a discharge member in said body adapted to discharge said water stream as a plurality of subsidiary streams in concentric patterns; and a cap mounted on said body to receive said subsidiary streams, said cap having a plurality of openings aligned to coincide with said subsidiary stream patterns to pulse said subsidiary streams when said discharge member is rotated.

2. The hydrotherapy jet of claim 1, wherein said discharge member is rotatably mounted in said body to rotate about an axis in response to a received water stream and discharge said subsidiary stream in said plurality of concentric patterns.

3. The hydrotherapy jet of claim 2, wherein said discharge member includes a plurality of conduits that divide the water stream and are oriented so that water flowing through the discharge member imparts a turning moment to said member that causes it to rotate and form said concentric patterns.

4. The hydrotherapy jet of claim 3, wherein said conduits present the appearance of asymmetric bunny ears.

5. The hydrotherapy jet of claim 3, wherein said openings are, tapered in the direction of water flow.

6. The hydrotherapy jet of claim 5, wherein respective pluralities of said openings are substantially aligned with each of respective said conduits.

7. The hydrotherapy jet of claim 5, wherein said discharge member conduits have outlets at different distances from said discharge member axis.

8. The hydrotherapy jet of claim 7, wherein at least one of said conduits is at an offset with an axis that is non-parallel to said discharge member's axis of rotation, said conduit axis being displaced at least 25 degrees in a direction coplanar with said discharge member axis and further displaced at least 6 degrees in a direction normal to said plane.

9. A spa system, comprising:

a spa shell that is capable of holding water;

at least one pulsating hydrotherapy jet mounted around said spa shell;

a water pump system that provides water to said jets;

each of said pulsating hydrotherapy jets, comprising:

a jet body;

a water inlet to said body;

a channel within said body for forming water flowing through said inlet into a water stream;

a discharge member in said jet body adapted to discharge said water stream in a plurality of subsidiary streams with respective concentric patterns; and a cap mounted on said body to receive said subsidiary streams, said cap having respective pluralities of openings aligned with respective ones of said subsidiary stream patterns to pulse said subsidiary streams when said discharge member rotates.

10. The spa system of claim 9, wherein said discharge member is rotatably mounted in said body to rotate about an axis in response to a received water stream and discharge said water stream in said plurality of concentric patterns, and said discharge member includes a plurality of conduits that divide the water stream and are oriented so that water flowing through the discharge member imparts a turning moment to said member that causes it to rotate and form said concentric patterns.

11. The spa system of 10, wherein at least one of said conduits is at an offset with an axis that is non-parallel to said discharge member's axis of rotation, said conduit axis being displaced at least 25 degrees in a direction coplanar with said discharge member axis and further displaced at least 6 degrees in a direction normal to said plane.

* * * * *